US006794564B2

(12) United States Patent
Louis

(10) Patent No.: US 6,794,564 B2
(45) Date of Patent: Sep. 21, 2004

(54) WIND INSTRUMENT

(76) Inventor: François Louis, Rue du Presbytère, 11, Ciplet (BE), 4260

( * ) Notice: Subject to any disclaimer, the term of this patent is extended or adjusted under 35 U.S.C. 154(b) by 0 days.

(21) Appl. No.: 10/208,101

(22) Filed: Jul. 29, 2002

(65) Prior Publication Data

US 2003/0024373 A1 Feb. 6, 2003

(30) Foreign Application Priority Data

Aug. 2, 2001 (EP) ..... 01870170

(51) Int. Cl.[7] ..... G10D 7/08
(52) U.S. Cl. ..... 84/385 R; 84/380 R; 84/382
(58) Field of Search ..... 84/385 R, 380 R, 84/382, 383 R, 383 A

(56) References Cited

U.S. PATENT DOCUMENTS

| | | | | |
|---|---|---|---|---|
| 1,727,868 A | * | 9/1929 | Dreves | 84/385 P |
| 1,805,929 A | | 5/1931 | Friedrich | |
| 2,232,151 A | | 2/1941 | Trew | |
| 4,250,791 A | | 2/1981 | Tairadate | |
| 4,341,146 A | | 7/1982 | Massa | |
| 5,044,248 A | | 9/1991 | Kenmochi | |
| 5,289,752 A | * | 3/1994 | Barbaglia | 84/383 R |
| 5,717,151 A | | 2/1998 | Straubinger | |
| 5,728,957 A | * | 3/1998 | Valtchev | 84/383 R |
| 5,801,297 A | | 9/1998 | Mifsud et al. | |
| 6,225,541 B1 | | 5/2001 | Kodera et al. | |

FOREIGN PATENT DOCUMENTS

| | | |
|---|---|---|
| EP | 0762379 | 3/1997 |
| WO | WO 9703436 | 1/1997 |
| WO | WO 9838627 | 9/1998 |

* cited by examiner

*Primary Examiner*—Shih-yung Hsieh
(74) *Attorney, Agent, or Firm*—Gerald T. Gray, Esq.; Townsend and Townsend and Crew LLP

(57) ABSTRACT

A wind instrument such as a saxophone, a clarinet or an oboe comprises touchpieces actuating covers via linkages. In this instrument, which can comprise two bodies side by side, shanks of the covers are fixed to the links by a removable fixing so as to allow the covers to be removed and aligned at least angularly with respect to the corresponding links.

26 Claims, 6 Drawing Sheets

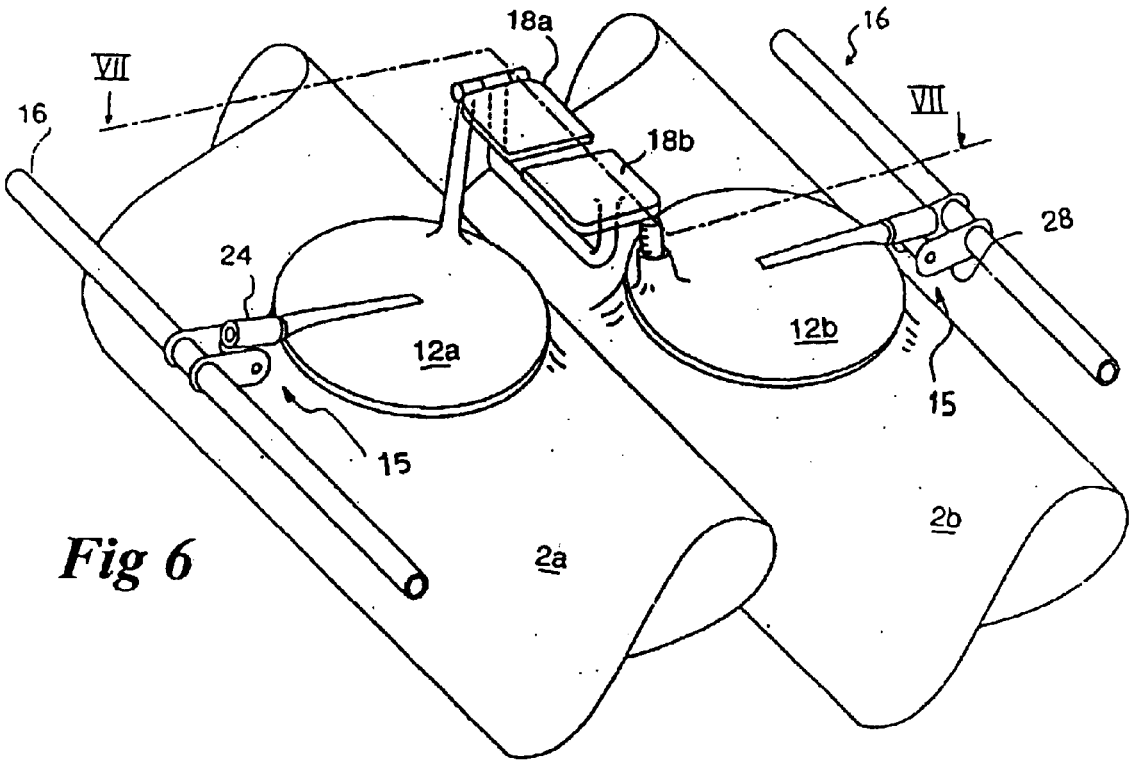
Fig 6
Fig 7
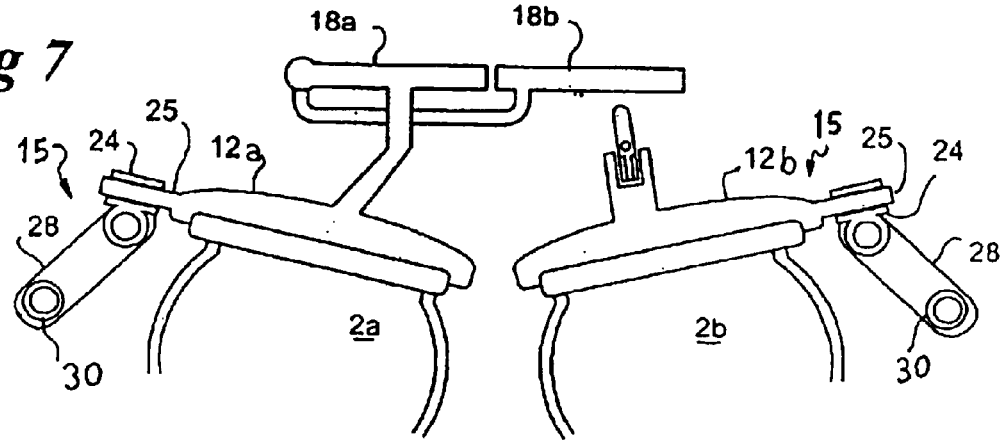

WIND INSTRUMENT

CROSS-REFERENCES TO RELATED APPLICATIONS

Not Applicable

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

The invention relates to wind instruments of the woodwind family, even those generally made of metal (such as Boehm flutes or saxophones), and, more particularly, double or single reed instruments such as oboes, bassoons, cors anglais (English Horns), clarinets, saxophones, taragots or the like.

In this field, the instruments—particularly high quality instruments—are generally manufactured in limited production runs and the labor contribution to the cost price is extremely high.

One of the problems with which instrument makers are confronted is that, in addition to the time needed to actually manufacture them, each instrument has then to be adjusted and tuned, which again demands many hours on the part of highly skilled personnel.

A paradoxical consequence of this situation is that innovations are highly limited, the makers of instruments having a tendency to repeat proven designs, with a small margin for maneuver to conform to the requirements of the actual users: the musicians. The latter demand instruments with good tone which are robust, light in weight, and allow precise fingering.

Another problem stems from the maintenance of the instruments: their mechanisms, which are often delicate, do not readily tolerate the knocks and various other accidents to which they are subjected during handling. However, robustness means having heavily engineered mechanisms. One point to which many researchers have devoted attention is that of improving the tightness of the covers, either by using improved pads (U.S. Pat. No. 5,717,151) or by adding an articulation with a cup mounted at the end of the (fixed) shanks carrying the covers, thus improving the homogeneity of the contact (WO 98/38627). Some have sought to improve the linkage (U.S. Pat. No. 4,250,791) and its supports (EP 0 762 379).

Attempts have been made at giving the instruments mechanisms that facilitate adjustments and fingering quality without making the instruments heavier.

Attempts have also been made at making the most of the lightening of the instruments and of the improvement to the linkages to design an instrument which offers novel acoustic possibilities, such as a double bodied instrument which is as easy to handle as a traditional single bodied instrument.

Known multi body wind instruments are, in fact, with the exception of the "aulos" of ancient Greece, simple combinations of single instruments side by side (see U.S. Pat. Nos. 2,232,151, 4,341,146) without common linkages and do not make it possible to obtain truly innovative tones or possibilities of musical interpretation.

BRIEF SUMMARY OF THE INVENTION

The subject of the invention is a wind instrument comprising touchpieces actuating covers via a linkage, in which the shank of at least one of the covers is fixed to the link which actuates it by removable fixing allowing the said cover to be removed and adjusted at least angularly with respect to the said link.

According to a preferred embodiment, removable fixing comprises a fixed part formed of two spaced apart plates secured substantially perpendicularly to the corresponding link.

The fixing of a cover to a linkage preferably also allows the cover to be adjusted radially with respect to the link.

According to one advantageous embodiment, the moving part of the removable fixing comprises a split sleeve equipped with a clamping means and a substantially cylindrical rod able to be immobilized by clamping in this split sleeve.

According to a preferred embodiment, the linkage consists of thin walled hollow rods made of a lightweight and rigid material (such as stainless steel, carbon fiber, etc.) mounted on endpieces made of a friction material; the hollow rods are preferably made of stainless steel or carbon fiber and the endpieces are preferably made of brass, bronze, nylon or PTFE.

The linkages may also comprise adjustable stops following the same principle, which comprise a fixed part formed of two spaced apart plates, secured substantially perpendicularly to the link, and a pivoting finger.

According to an advantageous embodiment, the linkages are mounted so as to pivot on supports formed of T-shaped welded hollow section pieces, replacing the traditional keywork pillars.

According to one preferred embodiment, the linkages comprise needle return springs held on the keywork pillars by a corresponding yoke with a clamping screw, which allows them to be replaced easily in the event of breakage and, as the screw acts on the spring, allows the preload thereof to be adjusted.

Resonators are preferably arranged between the body of the instrument and at least one thumb support.

The neck strap loop by means of which the instrument is supported is advantageously associated with the thumb hook, which makes it possible to avoid deformation of the body.

According to one advantageous embodiment, the linkages comprise at least one touchpiece the movement of which is transmitted to the corresponding cover via a flexible filament equipped with a turn system acting on levers.

Another subject of the invention is a wind instrument as described hereinabove, in the form of an aulos, which comprises two bodies side by side, the linkages comprising a set of touchpieces allowing the corresponding covers of each of the two bodies to be actuated simultaneously and/or separately.

According to one advantageous embodiment, this instrument comprises two mouthpieces side by side so as to allow the two bodies to be blown into simultaneously and/or separately.

According to one preferred embodiment, the instrument comprises at least one reed held in place on its mouthpiece by a ligature formed of metal wires equipped with a tensioning device, the said wires resting against the mouthpiece via hollow metal tubes arranged longitudinally around the mouthpiece.

Other particulars and advantages of the invention will become apparent from the description hereinafter of some particular embodiments of the invention, reference being made to the appended drawings.

BRIEF DESCRIPTION OF THE DRAWINGS

FIG. 6 is a schematic perspective view of a set of touchpieces.

FIG. 7 is a schematic view in section on the plane VII—VII of FIG. 6.

DETAILED DESCRIPTION OF THE INVENTION

Figure 1:
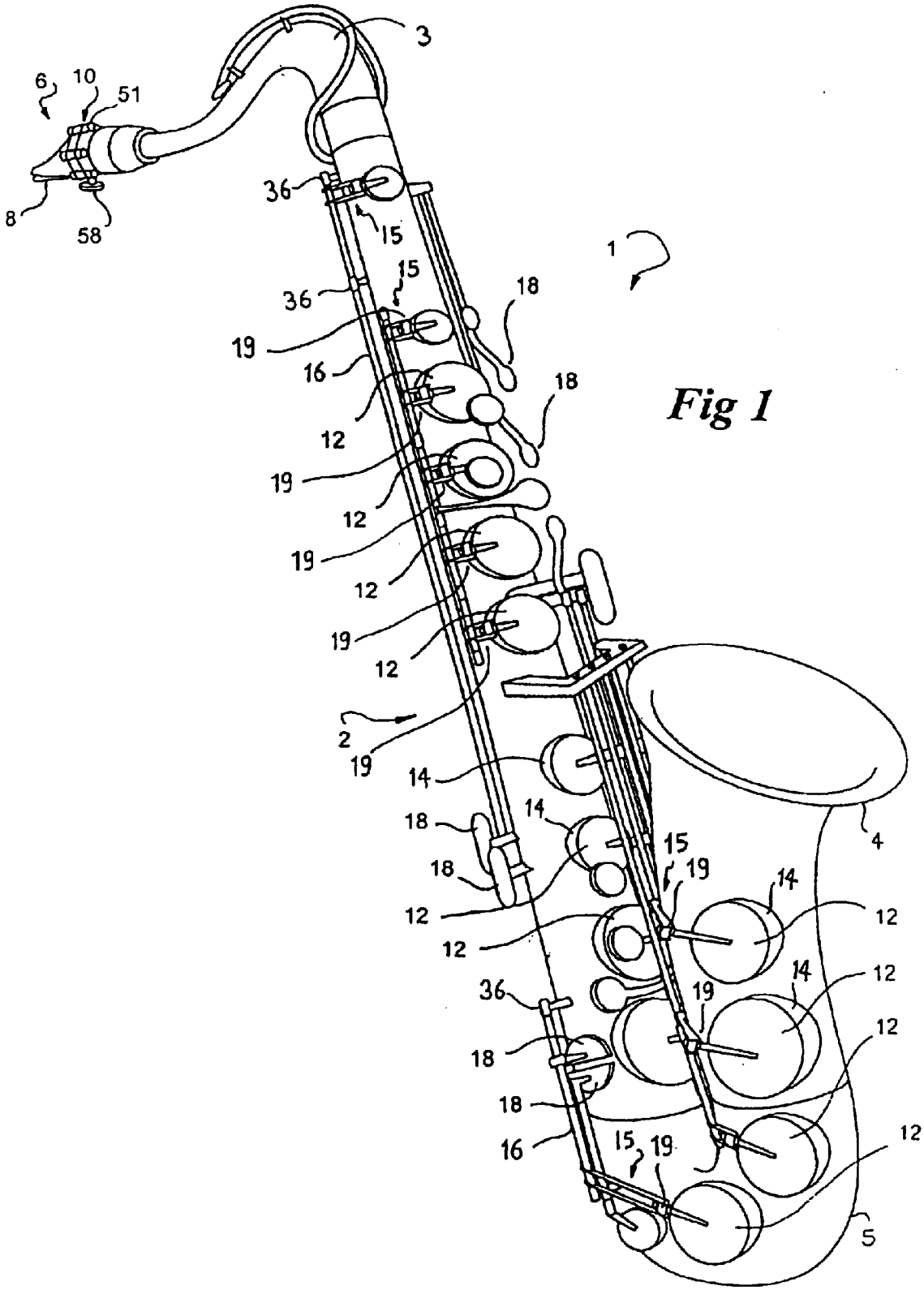
FIG. 1 is a general view of a musical instrument according to the invention.

FIG. 1 is a general view of a wind instrument 1 to which the improved mechanism of the invention is applied. Here in this instance it is a tenor saxophone, of which it is possible to see the body 2, the crook 3, the bell 4, the bow 5, and the mouthpiece 6 on which there is mounted a reed 8 held in place by a ligature 10. For reasons of conciseness, the assembly consisting of the crook, the body, the bow and the bell will be known hereafter in the text as the "body" 2.

The covers 12 (or cups) which press down onto collars 14 allowing the interpreter to produce the various notes are mounted on shanks 15 and are actuated either directly, or via links 16 actuated by touchpieces 18. The touchpieces 18 are gathered together in such a way as to be able to be actuated in a coordinated way by the fingers of the two hands of the player.

Figure 2:
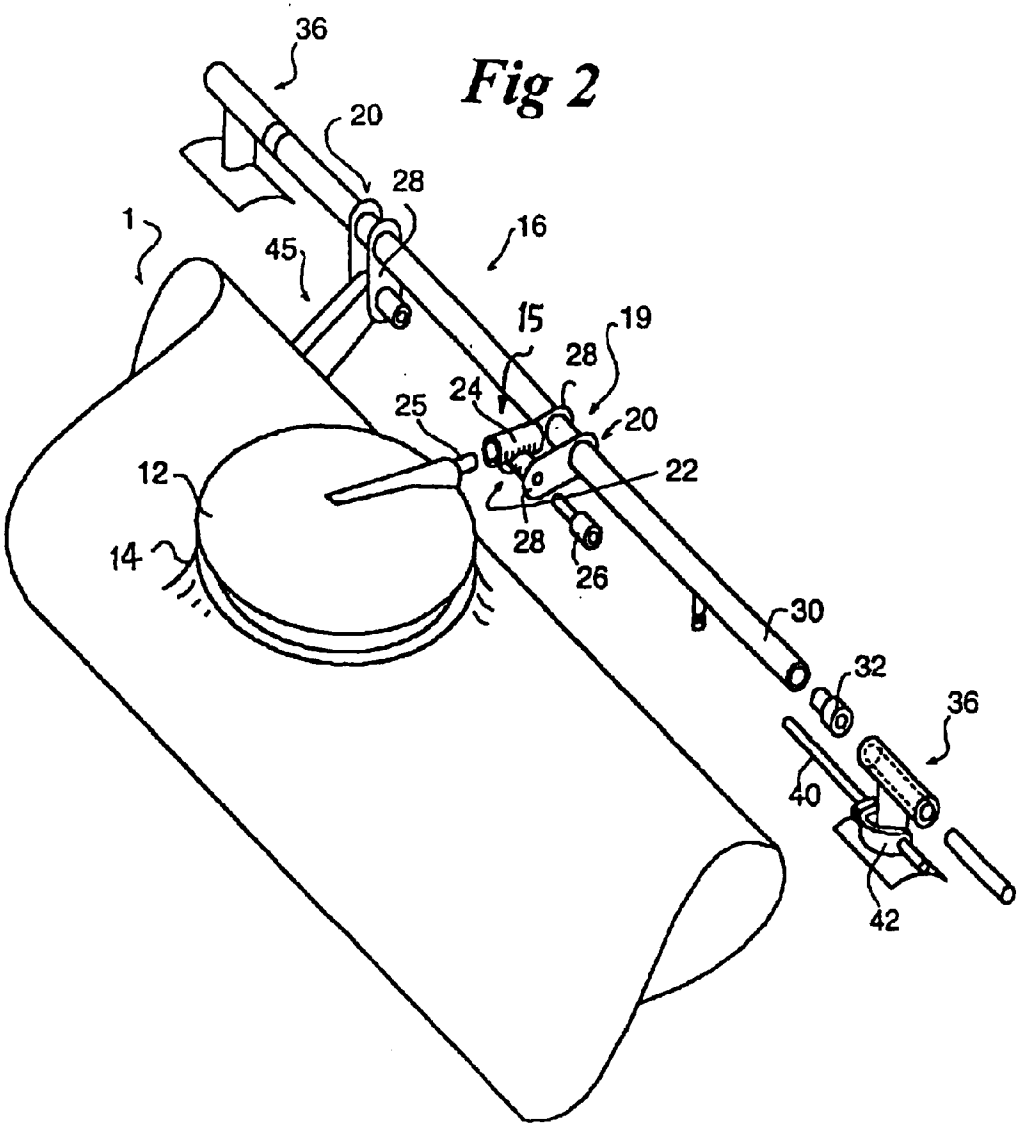
FIG. 2 is a schematic perspective and exploded view of a detail of an embodiment of the linkage of the invention.

The particulars of the instrument 1 are better apparent in the detailed view of FIG. 2. In this instrument 1, unlike a conventional instrument with linkages made of solid brass bars connected rigidly, the shanks 15 on which the covers 12 are mounted are connected to the links 16 removably, by means of a removable fixing 19 allowing the cover 12 and the link 16 to be disconnected quickly and allowing the relative position of these two parts to be adjusted.

The removable fixing 19 of the shank 15 shown in FIG. 2 comprises a fixed part 20 formed of two plates 28 secured to the link 16 and an angularly adjustable pivoting part 22. The fixing 19 shown in FIG. 2 additionally offers a possibility of radial adjustment with respect to the link 16: the pivoting part 22 comprises a split sleeve 24 in which a substantially cylindrical rod 25 (secured to the cover 12) is inserted. A screw 26 acts both as the pivot axle for the pivoting part 22 and as a clamping means for the split sleeve 24. The two plates 28 are parallel and substantially perpendicular to the link 16.

By slackening the screw 26 it is possible simultaneously to correct the inclination of the cover 12, its parallelism and its radial position with respect to the link 16.

The advantage of the invention becomes apparent when referring to FIG. 1: the linkages of a saxophone are complex; the links 16 and mechanisms actuating the various covers 12 are nestled amongst each other and have therefore to be removed in a strict order. In consequence, even the simplest repair or adjustment entails, especially if the problem is located in the low notes, a lengthy dismantling operation and the need for scrupulous readjustment of all the parts with respect to each other (particularly the relative position of the covers and of the touchpieces which actuate them).

In contrast, the linkage with shanks 15 and removable fixing according to the invention allows selective intervention and, where adjustment is needed (particularly after replacing the pad of a cover 12), allows this adjustment to be performed without altering positions of the other parts. The plates 28 for their part afford, unlike the bent or welded rods used conventionally, a light connection, free of play and greatly insensitive to torsion.

As the pressure of the covers on the periphery of the collars can easily be balanced, the pads wear far more uniformly and have therefore to be replaced far less frequently.

Something else which differentiates the links 16 of the invention from those of a conventional instrument is that instead of calling upon bars made of brass (a heavy and relatively ductile metal) the links 16 are made of thin walled metal section pieces 30 (in this instance, of stainless steel tubes), making it possible, for an infinitely lower weight of material, to obtain considerably enhanced mechanical properties (particularly resistance to torsion). To preserve the ease of machining and the centering of these thin walled tubes 30, cylindrical endpieces 32 made of a friction material such as brass, bronze or even nylon or PTFE are inserted into their ends. The weight saving achieved, the lower inertia of the mechanism, its improved rigidity and the reduction in friction between the various parts involved have an unexpected consequence as far as users of the instrument are concerned: their performance can be more precise, thus opening the way to further possibilities for interpretation (particularly by virtuosos) who can develop a more precise feel or can play more quickly, and also for composers.

It is also possible to inject an expanding foam of the polyurethane type into the hollow section pieces 30, thus improving their impact resistance and avoiding the onset of any possible parasitic vibrations.

Figure 4:
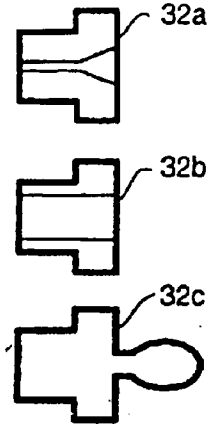
FIG. 4 is a sectional view of a series of alternative forms of endpieces for the linkage of the invention.

The attached endpieces 32 afford another advantage: when play ultimately arises in the linkage, it is no longer necessary to carry out costly remachining of the parts, as in the prior art: all that is actually required is for the endpieces 32 to be replaced, which endpieces are produced in standard sizes (see FIG. 4) and the small sizes of which allow them to be stored at low cost. As can be seen in FIG. 4, there are various alternative forms of these endpieces 32 which may be equally suitable for centering the linkage 32*a* for use as bearings 32*b* or for butting parts together 32*c*.

In order to make the instrument even lighter, and also to improve its resonance properties, the linkage supports 36 or "keywork pillars", traditionally made of solid brass (cf.

document EP 0 762 379), are made of hollow tubes assembled into a T. Here, use is preferably made of brass, the resonant frequency of which is close to that of the body of the instrument; something which is usually considered to be an impediment to the development of the timbre of the instrument here becomes a harmonic benefit.

One important embodiment detail is that the return spring 40 that returns the link 16 and which, as in conventional instruments, is in the form of a needle 40 is not clamped in the keywork pillar 36 but is held in a yoke 42 with a clamping screw, thus allowing it to be replaced easily if it should break (which is something that happens fairly often) and which furthermore allows its preload to be adjusted by action upon the clamping screw.

Figure 3:
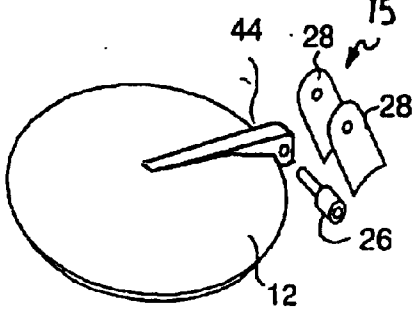
FIG. 3 is a perspective view of another embodiment of the covers of the instrument of the invention.

FIG. 3 illustrates another possible embodiment of the moving part 22: since the position of certain covers 12 places them practically out of reach of becoming maladjusted radially as a result of impacts or knocks, the moving part 22 is formed on the shank 15 of the cover or consists in a simple ring 44 welded or brazed directly to it.

As shown by FIG. 2, the stops 45 that make it possible to fix the position of the covers 12 at rest may also be equipped with an adjustable fixing on two plates 28 perpendicular to the link 16 and identical to those of the covers 12, and this allows the musician, in a few turns of a screw, to adjust the instrument in his hand.

This stop may, as depicted, be equipped with a leg of fixed length or a nozzle equipped with an adjustable stop screw, possibly itself mounted on double plates 28.

Figure 9:
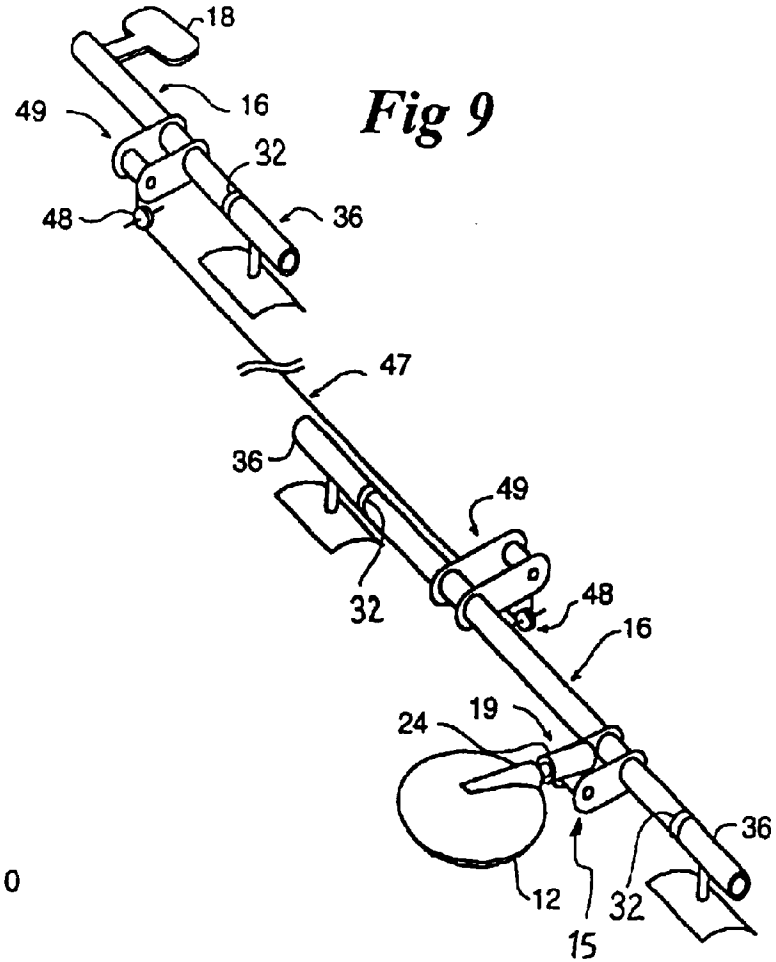
FIG. 9 is a schematic perspective view of a cable transmission of the instrument of the invention.

Another feature of the instrument of the invention is illustrated in FIG. 9. Certain covers 12, essentially those which are normally kept closed, require only a small amount of force, afforded by a spring. The linkage needed to actuate them may, in the light of their position, be very long and also very bulky. In the improved mechanism of the invention, this linkage is replaced by a flexible cable 47 acting, via two turn members 48, on levers 49 secured respectively to a touchpiece 18 and to the corresponding cover 12. This arrangement is particularly advantageous in the case of the side covers 12, and for alternative fingerings.

This cable 47 advantageously consists of a nylon filament and is provided with a tensioning device (not depicted). The turn members 48 are, for example, hooks with sliding contact or pulleys 48.

Figure 8:
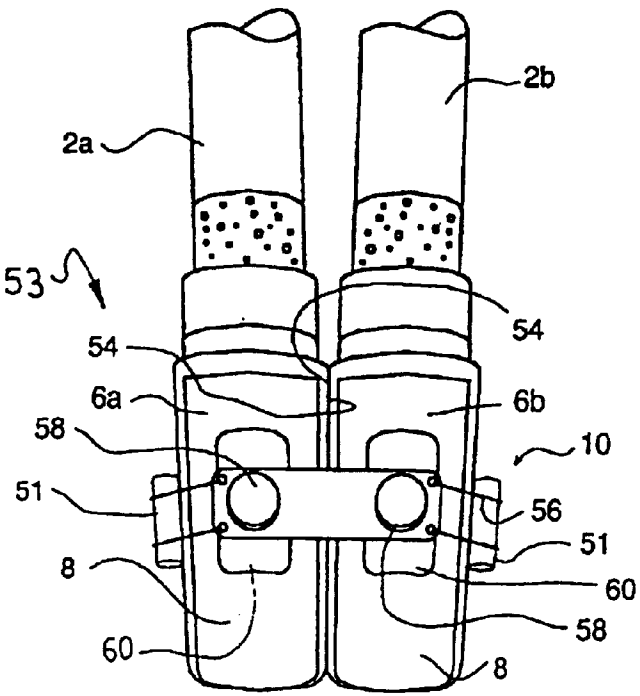
FIG. 8 is a view from above of the mouthpiece of the instrument depicted in FIG. 5.

A ligature 10, one particular embodiment of which is illustrated in FIG. 8, consists of metal wires 56 tensioned by a screw 58 on hollow metal cylinders 51. This ligature, via a pressure plate 60, holds the reed 8 firmly on the mouthpiece 6, but also develops harmonics and thus plays a part in developing the particular timbre of the instrument.

Figure 5:
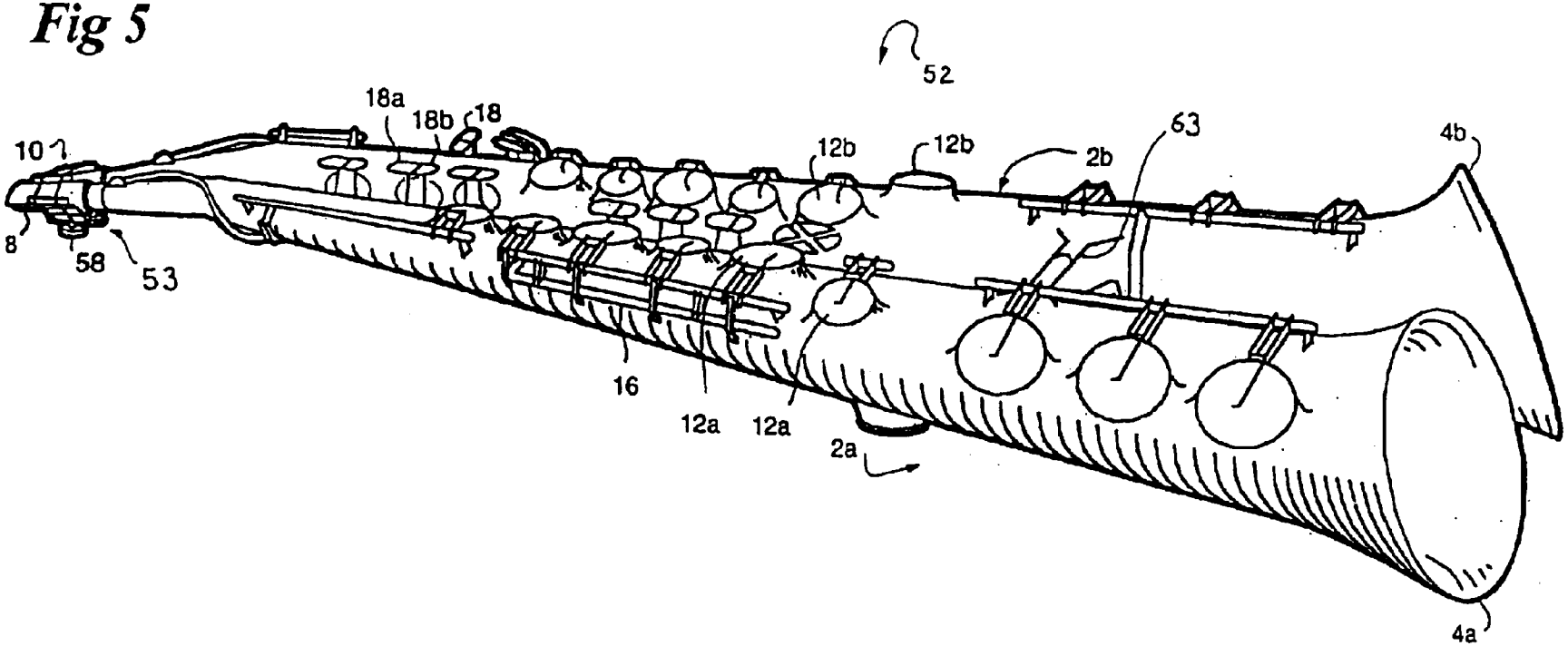
FIG. 5 is a general perspective view of a double instrument according to the invention.

The lightening of the instrument of the invention and the possibility of operating without difficulty on the position of each cover 12 have made it possible to develop an entirely novel type of double bodied instrument 52, one example of which is illustrated in FIG. 5.

This is a saxophone equipped, like an aulos, with a double body 2*a*, 2*b*. This instrument 52 is no heavier than a conventional single bodied instrument, and in addition offers far broader musical options. In particular, by virtue of its double body, it makes it possible to produce additional and/or differential sounds (through the addition or subtraction of the frequencies produced), which broadens the compass achieved by each of the two bodies 2*a*, 2*b*.

The current double instrument 52, unlike the known double instruments quoted in the preamble, is provided with a linkage with turn structures allowing the interpreter to actuate, with the same finger, as shown schematically in FIG. 5, the corresponding covers on both of the two bodies 2*a*, 2*b*.

In terms of range, the right hand body 2*a* normally gives out lower notes than the left hand one (2*b*). This is a simple option and it is perfectly possible without departing from the scope of the invention, to choose the opposite option.

The bearing surfaces of the touchpieces 18*a*, 18*b* are side by side and their travels are adjusted so that the interpreter can actuate them with an imperceptible movement of fingers. It is also possible to provide touchpieces 18*ab* (not depicted) which simultaneously actuate homologous covers 12*a*, 12*b* on both bodies 2*a*, 2*b*. These touchpieces 18*ab* are grouped together appropriately with the touchpieces 18*a*, 18*b* that actuate the covers 12*a*, 12*b* of each of the two bodies 2*a*, 2*b* separately. This particular mechanism allows the interpreter to place certain musical passages in unison or in counterpoint, and do so across the entire range of each of the two bodies of the instruments, unlike that which is permitted by the instrument described in U.S. Pat. No. 4,341,146.

As the touchpieces 18*a*, 18*b*, or even 18*ab* are arranged practically like on a conventional instrument (with a single body) it takes very little time for an instrumentalist accustomed to a conventional set of fingering to learn the special features involved in playing the current instrument 52.

The current instrument 52 allows uncustomary associations and opens the way to the creation of novel musical works.

The double instrument 52 of the invention, as shown in FIG. 5, uses a double mouthpiece 53 (see FIG. 8). This comprises two separate reeds 8 each one arranged along the axis of one of the bodies 2*a*, 2*b*. The double mouthpiece 53 can be likened to two single mouthpieces 6*a* and 6*b*, the proximal faces 54 of which have been pared down so as to obtain a common plane.

The two mouthpieces are wedged together; enough space is left between the planes of each of the two half-mouthpieces to allow them to vibrate autonomously at different frequencies without interfering with each other; these two half mouthpieces form just one entity equipped with two resonating cavities, the harmonization of which may differ.

It is found that, surprisingly, the double mouthpiece 53 allows the musician not only to blow homogeneously into the two "half instruments" but also, with a little practice, to direct his breath selectively or proportionately into each of the half instruments.

The problem that holding the two reeds 8 on the double mouthpiece 53 firmly and in a balanced way may pose is solved by the use of a ligature 10 consisting of metal wires 56 tensioned by two separate screws 58 on hollow metal cylinders 51. This ligature 10 not only, via separate pressure plates 60, ensures independent holding of each of the reeds 8, but also ensures the development of harmonics and thus plays a part in developing the particular timbre of the instrument.

To simplify the linkage, the double instrument depicted in FIG. 5 is formed of two bodies one of which is "inverted", that is to say that the right hand body is a "left handed" instrument. It goes without saying, that the principle of the invention applies equally to right bodies side by side.

Figure 10:
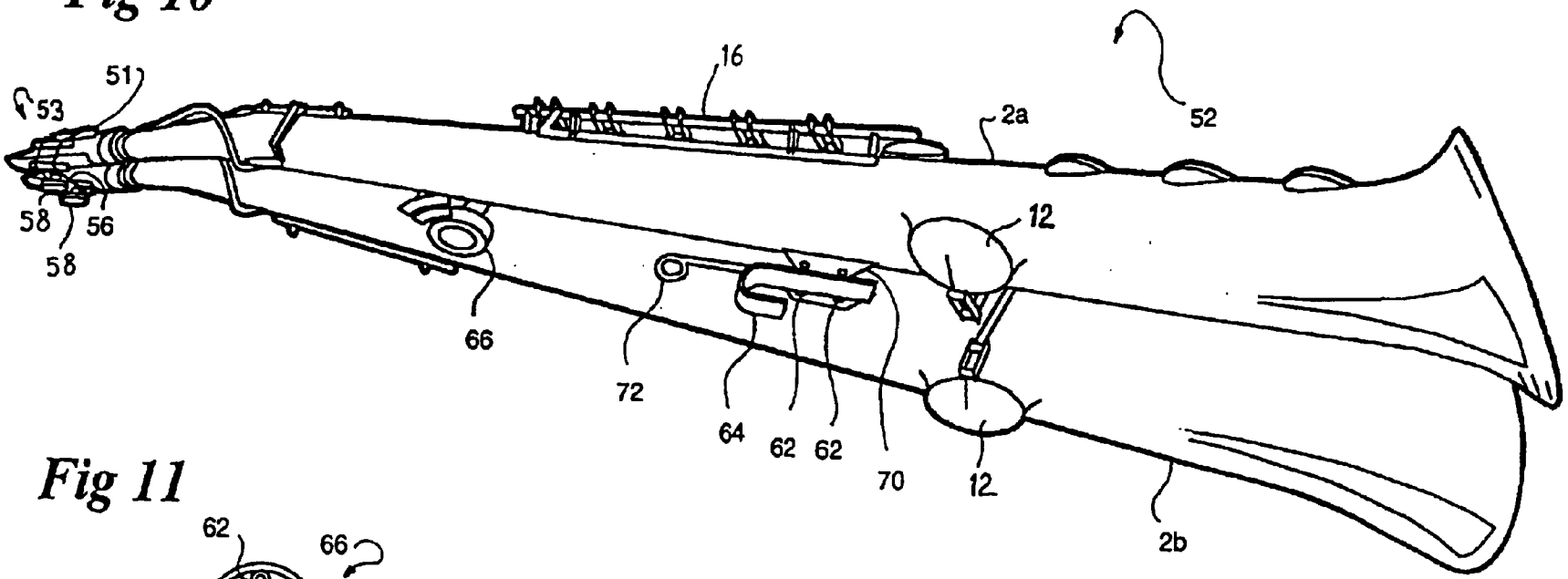
FIG. 10 is a schematic perspective view of the underside of the instrument of FIG. 5.

The timbre of the instrument of the invention is also improved by the addition of resonators 62 arranged between the body of the instrument and the thumb supports 64, 66 as shown in FIG. 10.

The right hand thumb hook 64 and the left hand thumb button 66 are actually secured to the body of the instrument via resonant cylinders 62.

Figure 11:
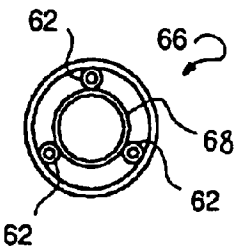
FIG. 11 is a detailed view of the left thumb rest of the instrument of FIG. 10.

FIG. 11 shows three resonant cylinders 62 fixed between the button itself 66 and a cylinder 68 which acts as a support for it.

FIG. 10 shows the special design of the thumb hook 64.

The thumb hook 64 is welded to two cylinder portions 62 arranged transversely, screwed onto longitudinal strips 70 welded to each of the two bodies 2*a*, 2*b*. In the case of the double instrument 52, these cylinders 62 also, together with the pins 63 (just one of which is visible in FIG. 5) contribute to holding the two bodies side by side. A design aspect which is original on two fronts is that the neck strap loop 72 from which the instrument is supported is integral with the thumb hook 64.

This construction offers a series of advantages both in terms of the sound quality and in terms of the durability of the instrument. What happens is that the bearing point that the neck strap loop 72 constitutes also benefits from the interposition of resonators 62. Furthermore, the tension that certain musicians place on the loop 72 when inhaling is transmitted directly to the thumb hook 64 (which avoids deformation to the body of the instrument). Furthermore, the stresses are better distributed and, finally, in the event of breakage, the loop 72 can be replaced with a few turns of a screw.

All documents and Patents referred to herein are each hereby incorporated by reference in its entirety for all purposes. While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. Wind instrument comprising touchpieces actuating covers via a linkage, wherein a shank of at least one of the covers is fixed to a link which actuates it by a removable fixing allowing the cover to be removed and adjusted at least angularly with respect to the link.

2. Wind instrument according to claim 1, wherein the removable fixing comprises a fixed part formed of two spaced apart plates secured substantially perpendicularly to the corresponding link.

3. Wind instrument according to claim 1, wherein the removable fixing also allows the cover to be adjusted radially with respect to the link.

4. Wind instrument according to claim 3, wherein a moving part of the removable fixing comprises a split sleeve equipped with a clamping means and a substantially cylindrical rod fitted so as to be immobilized by clamping in the split sleeve.

5. Wind instrument according to claim 1, wherein at least one link includes thin walled hollow section pieces mounted on endpieces made of a friction material.

6. Wind instrument according to claim 5, wherein the thin walled hollow section pieces are made of a material selected from the group consisting of stainless steel and carbon fibers and the endpieces are made of a material selected from the group consisting of brass, bronze, nylon and PTFE.

7. Wind instrument according to claim 1, wherein links comprise adjustable stops mounted on double plates.

8. Wind instrument according to claim 1, wherein links are mounted so as to pivot on supports formed of T shaped welded hollow section pieces.

9. Wind instrument according to claim 1, wherein the linkage comprises a needle return spring held on a corresponding keywork pillar by a yoke with a clamping screw.

10. Wind instrument according to claim 1, wherein resonators are arranged between a body of the instrument and at least one thumb support.

11. Wind instrument according to claim 1, wherein a neck strap loop for supporting the instrument is secured to a thumb hook.

12. Wind instrument according to claim 1, wherein the linkage comprises at least one touchpiece the movement of which is transmitted to at least one corresponding cover via a flexible filament equipped with a turn system and acting on levers secured respectively to the cover and to the touchpiece.

13. Wind instrument according to claim 1, which comprises at least one reed held in place on its mouthpiece by a ligature formed of metal wires equipped with a tensioning device resting on the reed, the wires resting against the mouthpiece via hollow metal tubes acting as resonators arranged longitudinally around the mouthpiece.

14. Wind instrument according to claim 1, which comprises two bodies side by side, the-linkage comprising a set of touchpieces allowing the corresponding cover of each of the two bodies to be actuated simultaneously.

15. Wind instrument according to claim 14, which comprises two mouthpieces side by side, each equipped with a reed so as to allow the two bodies to be blown into simultaneously or separately.

16. Wind instrument according to claim 14, which comprises at least one reed held in place on its mouthpiece by a ligature formed of metal wires equipped with a tensioning device resting on the reeds, the wires resting against the mouthpiece via hollow metal tubes acting as resonators arranged longitudinally around the mouthpiece.

17. Wind instrument comprising touchpieces actuating covers via a linkage, wherein a shank of at least one of the covers is fixed to a link which actuates it by a removable fixing allowing the cover to be removed and adjusted at least angularly and radially with respect to the link, the moving part of the removable fixing comprising a split sleeve equipped with a clamping means and a substantially cylindrical rod fitted so as to be immobilized by clamping in the split sleeve, the removable fixing comprising a fixed part formed of two spaced apart plates secured substantially perpendicularly to the corresponding link.

18. Wind instrument according to claim 17, wherein at least one link includes thin walled hollow section pieces mounted on endpieces made of a friction material.

19. Wind instrument according to claim 18, wherein the thin walled hollow section pieces are made of a material selected from the group consisting of stainless steel and carbon fibers and the endpieces are made of a material selected from the group consisting of brass, bronze, nylon and PTFE.

20. Wind instrument according to claim 17, wherein links are mounted so as to pivot on supports formed of T shaped welded hollow section pieces.

21. Wind instrument according to claim 17, wherein the linkage comprises a needle return spring held on a corresponding keywork pillar by a yoke with a clamping screw.

22. Wind instrument according to claim 17, wherein the linkage comprises at least one touchpiece the movement of which is transmitted to at least one corresponding cover via a flexible filament equipped with a turn system and acting on levers secured respectively to the cover and to the touchpiece.

23. Wind instrument according to claim 17, which comprises two bodies side by side, the linkage comprising a set of touchpieces allowing the corresponding cover of each of the two bodies to be actuated simultaneously.

24. Wind instrument according to claim 23, which comprises two mouthpieces side by side, each equipped with a reed so as to allow the two bodies to be blown into simultaneously or separately.

25. Wind instrument according to claim 23, which comprises at least one reed held in place on its mouthpiece by a ligature formed of metal wires equipped with a tensioning device resting on the reeds, the wires resting against the mouthpiece via hollow metal tubes acting as resonators arranged longitudinally around the mouthpiece.

26. A wind instrument comprising touchpieces actuating covers via a linkage having a plurality of links, wherein a shank of at least one of the covers is fixed to a longitudinally extending link which actuates the cover by a removable fixing allowing the cover to be removed and adjusted at least angularly with respect to said link.

* * * * *